US006823991B2

(12) United States Patent
Breyer et al.

(10) Patent No.: US 6,823,991 B2
(45) Date of Patent: Nov. 30, 2004

(54) CONTAINER FOR USE WITH AND METHOD OF MANAGING AN OVERHEAD TRACK CHAIN

(75) Inventors: Scott T. Breyer, Dousman, WI (US); Kyle C. Stoehr, Oconomowoc, WI (US)

(73) Assignee: Oconomowoc Manufacturing Corporation, Oconomowoc, WI (US)

( * ) Notice: Subject to any disclaimer, the term of this patent is extended or adjusted under 35 U.S.C. 154(b) by 73 days.

(21) Appl. No.: 10/390,821

(22) Filed: Mar. 18, 2003

(65) Prior Publication Data

US 2003/0201152 A1 Oct. 30, 2003

Related U.S. Application Data

(60) Provisional application No. 60/376,584, filed on Apr. 30, 2002.

(51) Int. Cl.[7] ..... A44B 7/00

(52) U.S. Cl. ..... 206/348; 198/347.2; 414/332; 221/312 C

(58) Field of Search ..... 198/678.1, 347.2; 414/332; 104/172.4, 172.5; 221/312 C, DIG. 1, 191, 281; 206/348

(56) References Cited

U.S. PATENT DOCUMENTS

| | | | | |
|---|---|---|---|---|
| 441,454 A | | 11/1890 | Vileyn | |
| 2,943,732 A | | 7/1960 | Kovaleski et al. | 206/59 |
| 3,406,817 A | | 10/1968 | Lane et al. | 206/52 |
| 4,266,902 A | * | 5/1981 | Forsberg | 414/332 |
| 4,400,126 A | * | 8/1983 | Desourdy | 414/332 |
| 4,664,260 A | | 5/1987 | Stokes | 206/386 |
| 4,984,685 A | | 1/1991 | Douglas | 206/334 |
| 5,103,977 A | | 4/1992 | Douglas | 206/334 |
| D350,900 S | | 9/1994 | Goetz | D9/502 |
| 5,738,209 A | | 4/1998 | Burr et al. | 206/397 |

OTHER PUBLICATIONS

Jervis B. Webb Company, Parts and Service—Parts, http://www.jervisbwebb.com/jbw/partsandservicepage2parts.htm.
Jervis B. Webb Company, Unibilt Power & Free Conveyors Overhead and Inverted, Bulletin No. 8083, 2000.
Jervis B. Webb Company, Wide Wing Dog Magic Power & Free Overhead and Inverted Conveyor Systems, Bulletin No. 9183, 1999.

(List continued on next page.)

*Primary Examiner*—James R. Bidwell
(74) *Attorney, Agent, or Firm*—Whyte Hirschboeck Dudek SC

(57) ABSTRACT

A container for use with an overhead track chain is disclosed. The container generally comprises a base and a housing. The base includes a tapered spool that extends upwardly from a top surface of the base. The housing surrounds at least a portion of the tapered spool. Therefore, when the base and the housing are secured together the base, the tapered spool, and the housing form an overhead track chain storage area. The chain is stowed in the container when the chain is received in a winding fashion around the spool and within the overhead track chain storage area. When this occurs, the typically heavy and bulky overhead track chain, which includes links permitting the chain to swivel, can be easily packaged, stored, and subsequently transported within the container. A method of stowing the overhead track chain in the container is also disclose.

28 Claims, 9 Drawing Sheets

OTHER PUBLICATIONS

Jervis B. Webb Company, Unibilt Inverted Conveyors, Bulletin No. 8084, 2000.
Jervis B. Webb Company, Unibilt Over–N–Under Conveyors, Bulletin No. 8079, 1999.
Jervis B. Webb Company, Unibilt Enclosed Track Conveyors, Bulletin No. 8081, 2000.
Rapid Industries, Inc., Rapid Flow–Plus 4×4, http://www.rapidi.com/rapid4×4.htm.
Richards–Wilcox, Inc. Zig–Zag Monorail Conveyors, http://www.richards–wilcox.com/zigzag.htm.
Allied Conveyors, Enclosed Track, Continuous Powered, Overhead Monorail Conveyors, http://alliedconveyors.com/pages/continuous.html.
Allied Conveyors, Power & Free Overhead Monorail Conveyors, http://www.alliedconveyors.com/pages/power&free.html.

Autoflex Conveyors, Autoflex Enclosed Track Conveyors, http://www.asiconveyors.com/autoflex.com.

Canadian Industrial Conveyors, Standard Product Lines, http://www.canadianindustrialconveyors.com/product.htm.

Carris Reels brochure.

* cited by examiner

CONTAINER FOR USE WITH AND METHOD OF MANAGING AN OVERHEAD TRACK CHAIN

CROSS-REFERENCE TO RELATED APPLICATIONS

Priority is claimed to U.S. provisional patent application Ser. No. 60/376,584 filed on Apr. 30, 2002.

BACKGROUND OF THE INVENTION

1. Field of the Invention

The present invention relates generally to a container. In one aspect, the invention relates to a container for managing an overhead track chain.

2. Description of the Related Art

In conventional assembly line manufacturing, conveyor systems are often used to shuttle materials from a source to and through one or more workstations. These conveyor systems typically rely on one or more bulky chains, such as overhead track chains, to convey the requisite materials. The overhead track chains (i.e., universal link chains), which are out-fitted with and utilize "pusher dogs" and "trolleys", engage with, transport, and then disengage from the materials. As such, the materials can be carried through the assembly line by the overhead track chains where a variety of tasks can be performed on the materials at the workstations.

Unfortunately, the packaging, transporting, storing, and managing of the overhead track chains which are used in the conveyor systems can be extremely problematic. The overhead track chains are often very large and very heavy. Also, the chains are constructed of links that permit and encourage the chain to swivel or otherwise move at or between the links. This can cause difficulties, for example, when a manufacturer of the chains attempts to package the chains within conventional packaging and shipping containers, when the chains are removed from conveyor systems by technicians for maintenance, repair, replacement, installation and/or reconfiguration, and the like.

At present, manufacturers and users of overhead track chains employ a specially configured container with a "double box" design for packaging, shipping, transporting, and storing the chains. These double box containers use styrofoam spacers, which are disposed in corners and the center of the container, to secure and balance the chain that has been stowed therein.

Undesirably, the styrofoam spacers have a tendency to deteriorate over time. As a result, the overhead track chain packaged in the container shifts and/or slides when the container is moved. Therefore, the container is unstable and difficult for workers to carry and otherwise difficult to handle. Additionally, when the styrofoam spacers break apart, pieces or fragments of the styrofoam can become lodged in and around the overhead track chain stored in the container. If the styrofoam pieces are not adequately cleaned from the overhead track chain, various problems can arise. For example, the chain can fail prematurely during later use in the conveyor system.

Overhead track chains are also, at times, transported and shipped by manufacturers and users inside containers such as conventional buckets, pails, and the like. These buckets have a vacant and/or hollow interior, defined by a periphery of the bucket, which is devoid of any support feature. In other words, the periphery of the bucket is the only boundary restricting movement of the chain when the chain is disposed in the hollow interior. No structure or apparatus is provided within the hollow interior to guide, manage, and/or steadfastly secure the chain. Therefore, when the chain is disposed and/or placed within the bucket for transportation and/or shipping, the container is unable to adequately control the movements, sway, and shifting of the chain stored therein.

Thus, a container for use with, and for managing, an overhead track chain would be desirable. Likewise, a method of stowing an overhead track chain in the container would also be desirable.

SUMMARY OF THE INVENTION

In one aspect, the invention provides a container for use with an overhead track chain. The container comprises a base, which includes a spool, and a housing that is securable to the base. The spool extends from the base and is structured to progressively guide the overhead track chain around the spool in a winding fashion. The housing surrounds at least a portion of the spool such that an overhead track chain storage area is formed. The overhead track chain is guided around the spool in the winding fashion and received within the overhead track chain storage area.

In another aspect, the invention provides a container for managing an overhead track chain. The container comprises a base defining a top surface, a tapered spool defining an interior, and a cylindrical housing. The tapered spool is disposed upon, and extends diminishingly away from, the top surface of the base, has an accessory storage area disposed within the interior of the tapered spool, and is structured to progressively guide the overhead track chain around the tapered spool in a winding fashion. The cylindrical housing is securable to the top surface of the base and surrounds at least a portion of the tapered spool such that an overhead track chain storage area is formed. The overhead track chain is guided around the tapered spool in a winding fashion and received within the overhead track chain storage area.

In a further aspect, the invention provides a method of stowing an overhead track chain. The method comprises providing the overhead track chain and providing a container for managing the overhead track chain. The container includes a base having a tapered spool and a housing securable to the base. The tapered spool extends from the base and is structured to progressively guide the overhead track chain around the tapered spool in a winding fashion. The housing surrounds at least a portion of the tapered spool such that an overhead track chain storage area is formed. A vertically-oriented overhead track chain is introduced into the overhead track chain storage area within the container and the vertically-oriented overhead track chain is wound around the tapered spool in the overhead track chain storage area of the container until the overhead track chain is at least substantially entirely received within the overhead track chain storage area. Thus, the overhead track chain is stowed.

In yet another aspect, the invention provides a container in combination with an overhead track chain. The container comprises a base having a tapered spool and a housing securable to the base. The tapered spool extends from the base and is structured to progressively guide the overhead track chain around the tapered spool in a winding fashion. The housing surrounds at least a portion of the tapered spool such that an overhead track chain storage area is formed. The overhead track chain comprises a load-carrying link and a lateral guide link. Each of the load-carrying link and the lateral guide link has a universal pin and a universal pin aperture such that the load-carrying link and the lateral guide link are pivotable with respect to each other. The pivotable load-carrying link and the lateral guide link permit the overhead track chain to be guided around the tapered spool in the winding fashion and be received within the overhead track chain storage area. As such, the overhead track chain is at least substantially entirely disposed within the container.

BRIEF DESCRIPTION OF THE DRAWINGS

Embodiments of the invention are disclosed with reference to the accompanying drawings and are for illustrative purposes only. The invention is not limited in its application to the details of construction, or the arrangement of the components, illustrated in the drawings. The invention is capable of other embodiments or of being practiced or carried out in other various ways. Like reference numerals are used to indicate like components.

DETAILED DESCRIPTION OF THE PREFERRED EMBODIMENTS

Figure 1:
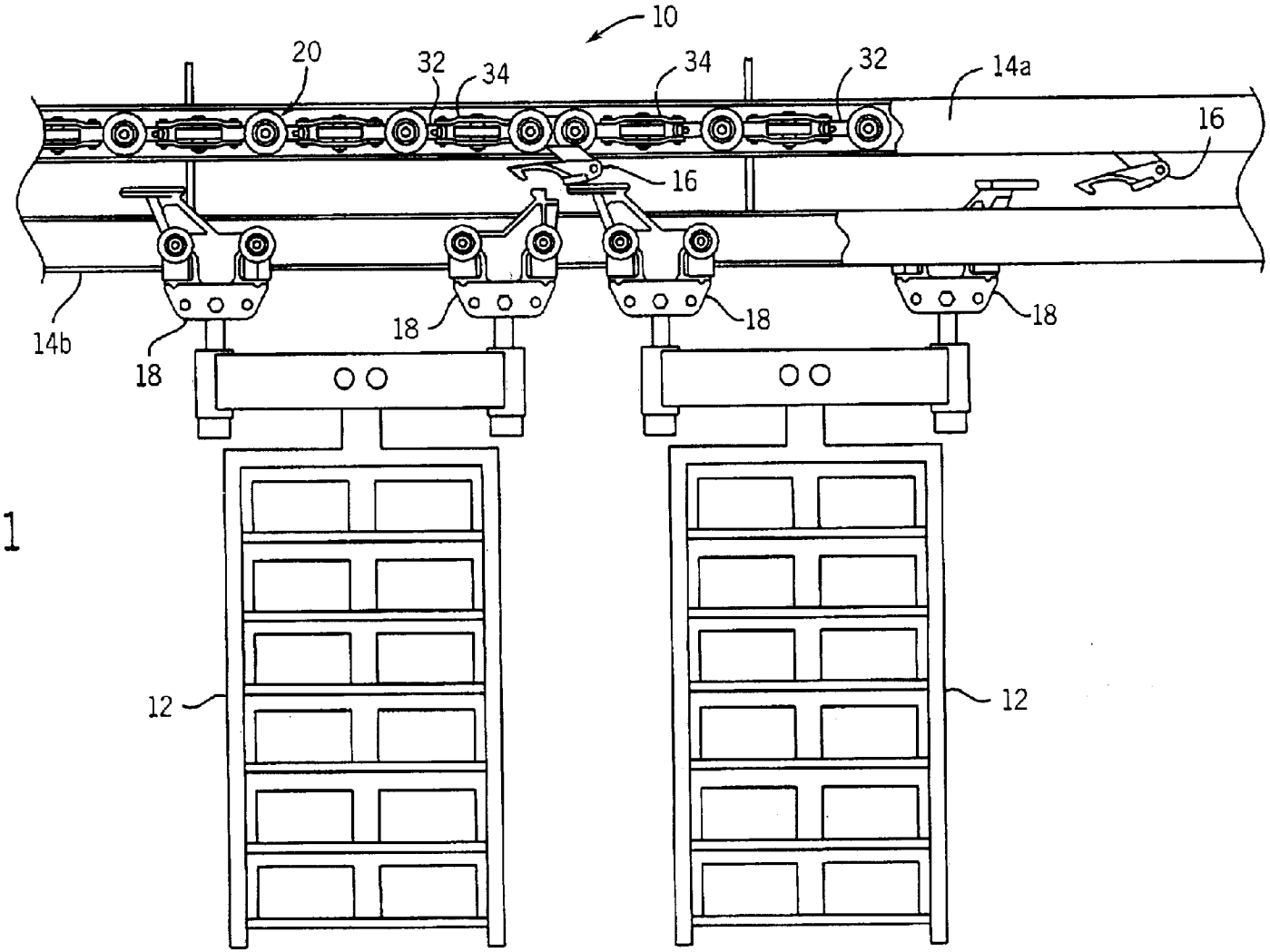
FIG. 1 illustrates a side view of a typical conveyor system capable of employing an overhead track chain.

Referring to FIG. 1, conveyor system 10 is illustrated transporting materials 12. Materials 12 can include parts, components, products, and the like that are ferried from place to place during typical assembly line manufacturing. Conveyor system 10 generally includes one or more Tracks 14*a* and 14*b* (collectively 14), one or more pusher dogs 16, one or more trolleys 18, and an overhead track chain 20 (i.e., a universal link chain). Overhead track chain 20 is often driven and/or pulled through track 14*a* in a conveyor system 10 such as, for example, track 14*a* which is positioned vertically above track 14*b*. In preferred embodiments, track 14*a* is an "enclosed" track and track 14*b* is either an "enclosed" track or an "open" track. In those embodiments where track 14*b* is an "open" track, the track is typically an I-beam track.

As shown in FIG. 1, a portion of each track 14 is cut-away or removed to more clearly illustrate components (e.g., overhead track chain 20, etc.) of conveyor system 10. Tracks 14 are structured to receive one or more pusher dogs 16, one or more trolleys 18, and overhead track chain 20. As such, pusher dogs 16, trolleys 18, and overhead track chain 20 are permitted to ride upon and/or through one of tracks 14. Tracks 14 are typically manufactured in, for example, either straight or curved sections (not shown) of about twenty feet in length. These sections are welded or otherwise secured together to permit tracks 14 to be as long or short, and as straight or meandering, as desired by a user of conveyor system 10. Since tracks 14 must ultimately support a considerable amount of weight (e.g., from materials 12, from various conveyor components, etc.) the Tracks are often constructed of, for example, high carbon steel.

Figure 2:
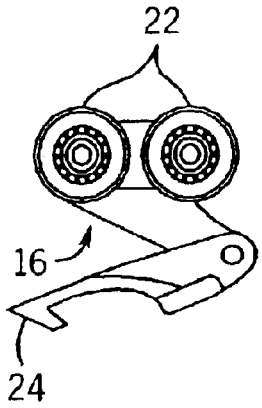
FIG. 2 illustrates a side view of a pusher dog used in the conveyor system of FIG. 1.

Pusher dogs 16, as shown in FIGS. 1 and 2, comprise pusher dog wheels 22 and catch 24. Pusher dog wheels 22 are structured to permit pusher dog 16 to travel in and through track 14*a*. Preferably, pusher dog wheels 22 rotate freely and are formed such that the pusher dogs can glide smoothly through track 14*a*. Catch 24 on pusher dog 16 is structured to permit the pusher dog to engage with one of trolleys 18.

Figure 3:
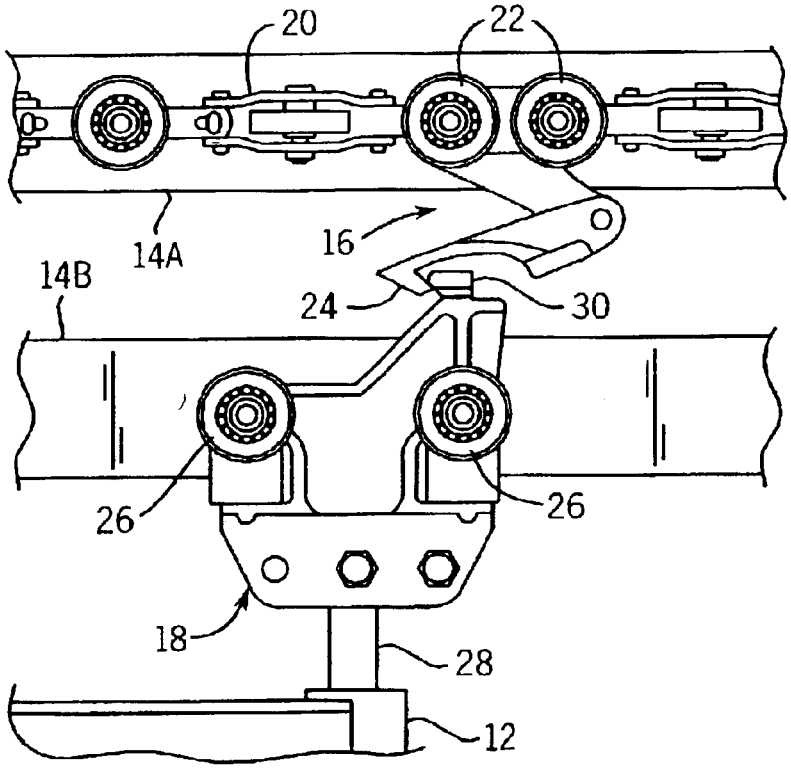
FIG. 3 illustrates a side view of a trolley used in the conveyor system of FIG. 1.

As shown in FIG. 3, trolley 18 comprises trolley wheels 26, means 28 for securing materials, and receiver 30. Trolley wheels 26 are structured to permit trolley 18 to travel on or through track 14*b*. Preferably, trolley wheels 26 rotate freely and are formed such that the trolleys can glide smoothly on or through track 14*b*. Means 28 for securing materials is structured to permit each trolley 18 to suspend and carry materials 12 from a source (not shown) to a workstation (not shown) or from one workstation to another. Receiver 30 is structured to permit trolley 18 to engage with catch 24 disposed on one of pusher dogs 16.

Figure 4:
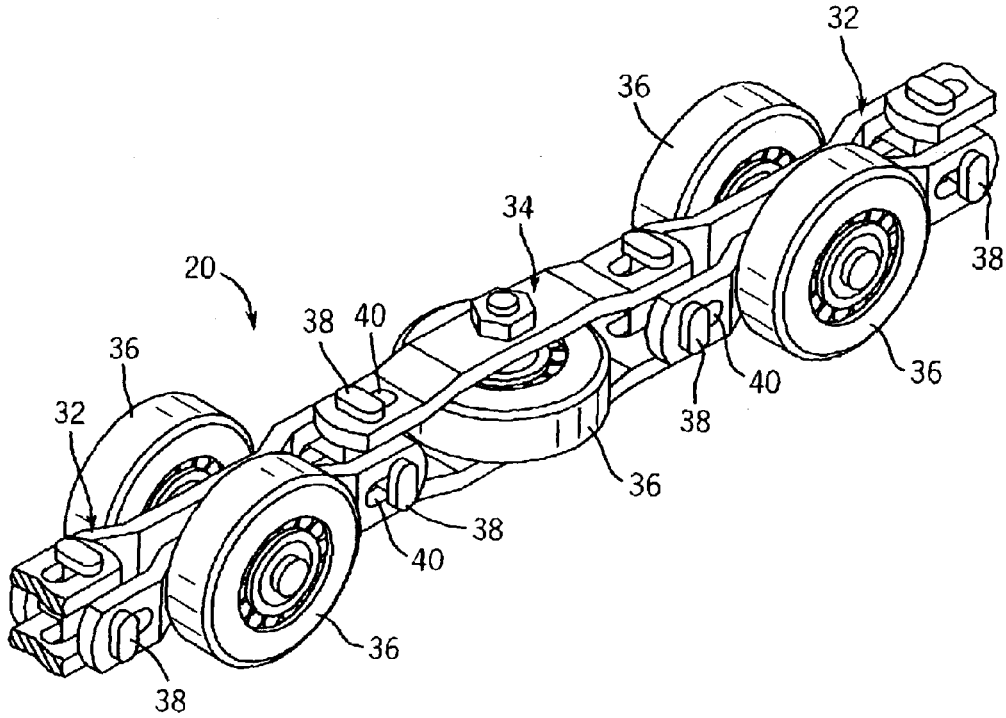
FIG. 4 illustrates a perspective view of the overhead track chain used in the conveyor system of FIG. 1.
Figure 5:
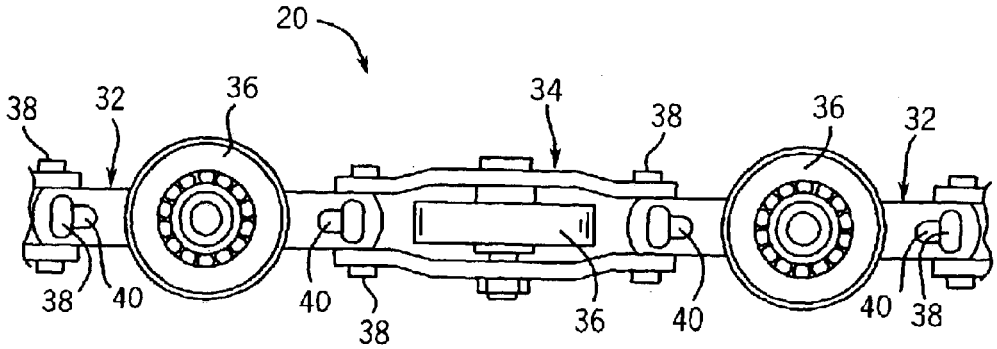
FIG. 5 illustrates a side view of the overhead track chain of FIG. 4.

In preferred embodiments as shown in FIGS. 4 and 5, overhead track chain 20 is produced by combining and/or securing together one or more load-carrying links 32 and/or lateral guide links 34. Preferably, a plurality or series of links 32, 34 are included in overhead track chain 20. Although permitted to be coupled together in a variety of sequences, load-carrying links 32 and lateral guide links 34 are preferably ordered such that the load-carrying links and the lateral guide links alternate in some fashion. For example, one or more load-carrying links 32 follow one or more lateral guide links 34, which are followed by additional load-carrying lengths, and so on and so forth. Each load-carrying link 32 and lateral guide link 34 includes one or more chain wheels 36, a plurality of universal pins 38, and a plurality of universal pin apertures 40.

In general, chain wheels 36 disposed on load-carrying links 32 accommodate vertically-applied loads while the chain wheels disposed on lateral guide links 34 manage laterally-applied loads. Since, for example, vertically-applied loads upon load-carrying links 32 are often substantial, multiple chain wheels 36 can be used in combination or together to bear the heavy load. Preferably, chain wheels 36 on each of load-carrying links 32 and lateral guide links 34 rotate freely and are formed such that the links can glide smoothly on or through one of Tracks 14. Chain wheels 36 can be constructed of steel, other metals, nylon, and the like.

Universal pins 38 and universal pin apertures 40 are found on both load-carrying links 32 and lateral guide links 34. Universal pins 38 and universal pin apertures 40 are selectively engageable such that load-carrying links 32 and lateral guide links 34 can be secured to one another. Likewise, several load-carrying links 32 can be secured other load-carrying links and several lateral guide links 34 can be secured to other lateral guide links. Therefore, when universal pins 38 and universal pin apertures 40 engage each other, links 32, 34 are connected and/or secured together such that overhead track chain 20 is produced.

Any number of load-carrying links 32 and lateral guide links 34 can be joined together to form overhead track chain 20. As links 32, 34 are added, overhead track chain 20 grows larger and larger in length. In contrast, as links 32, 34 are removed, overhead track chain 20 shrinks in length.

Since links 32, 34 are connected and/or secured by engagement of universal pins 38 and universal pin apertures 40, the links are permitted to swivel, pivot, and/or twist. Correspondingly, overhead track chain 20 can swivel, pivot, and/or twist.

Referring again to FIG. 1, one or more pusher dogs 16 are inserted or incorporated into overhead track chain 20 (FIG. 4) between links 32, 34 when the overhead track chain is used in conveyor system 10. Pusher dogs 16 can include universal pin apertures (not shown) that are compatible with universal pins 38 (FIG. 4) disposed on load-carrying links 32 and lateral guide links 34. When inserted into overhead track chain 20, pusher dogs 16 typically separate lateral guide links 34. In other words, pusher dogs 16 become a part or portion of overhead track chain 20 when the overhead track chain is used in conveyor system 10.

As overhead track chain 20 is driven and/or moves within and through track 14*a*, pusher dogs 16 that have been added to the chain engage with receivers 30 on trolleys 18 while the trolleys are securing materials 12 with means 28 for securing materials. Engagement of pusher dogs 16 and trolleys 18 causes the trolley to move on or through Tracks 14*b*. As overhead track chain 20 progresses through conveyor system 10, materials 12 held by trolleys 18 likewise and resultantly progress through the conveyor system. Therefore, overhead chain 20 rolls and "snakes" through track 14*a*, the chain uses pusher dogs 16 to pull trolleys 18 (including materials 12) on or through track 14*b* until the pusher dogs and the trolleys disengage. Thus, materials 12 are transported as desired by conveyor system 10.

While overhead track chain 20 performs well within conveyor system 10, the overhead track chain can be problematic prior to insertion into, or after removal from, the conveyor system. Simply put, overhead track chain 20 is difficult to package, transport, store, handle, maneuver, and otherwise manage (collectively "manage") when independent of conveyor system 10 since the chain is bulky, heavy, and can, if not constrained, swivel between engaged links 32, 34.

When outside of or apart from conveyor system 10, overhead track chain generally comprises only load-carrying links 32 and lateral guide links 34 as shown in FIG. 4. These load-carrying links 32 and lateral guide links 34 (including chain wheels 36) are often constructed of a high-strength metal (e.g., a drop-forged, high-strength steel) or other heavy, strong, and/or dense materials. Therefore, overhead track chain 20 is often extremely heavy. As more and more links 32, 34 are added to overhead track chain 20, the chain becomes increasingly bulky and heavy. Also, since links 32, 34 are commonly joined together by universal pins 38 and universal pin apertures 40, which permit swiveling, overhead track chain 20 is pivotable. In other words, overhead track chain can be cumbersome to manage and/or maneuver.

Figure 6:
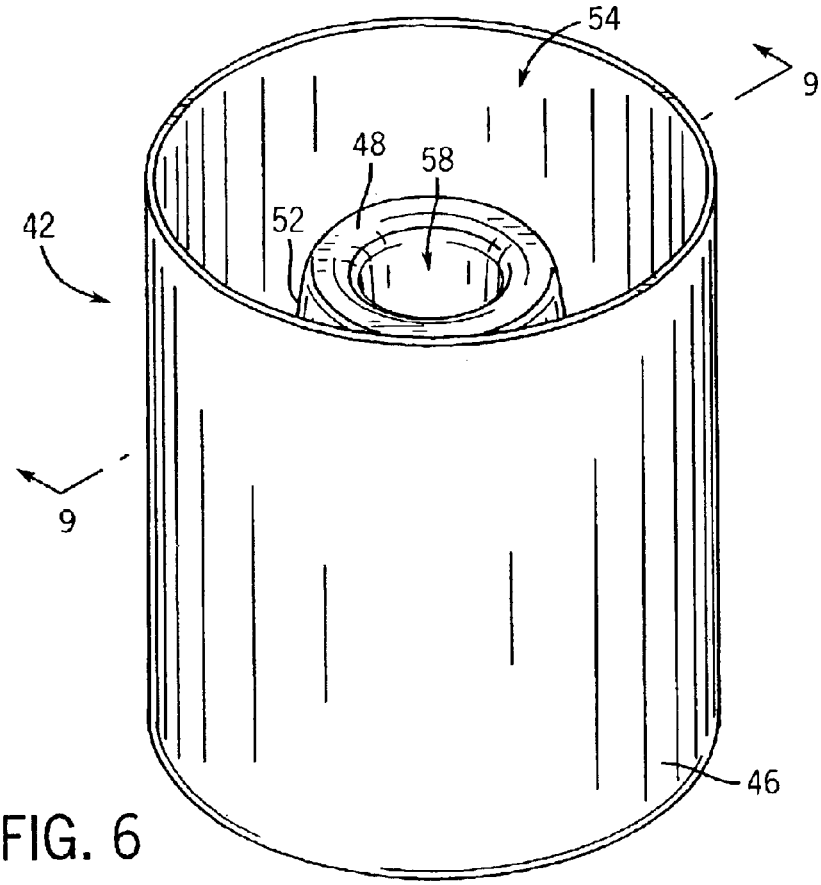
FIG. 6 illustrates a perspective view of one embodiment of a container for storing the overhead track chain of FIG. 4 in accordance with one aspect of the present invention.
Figure 7:
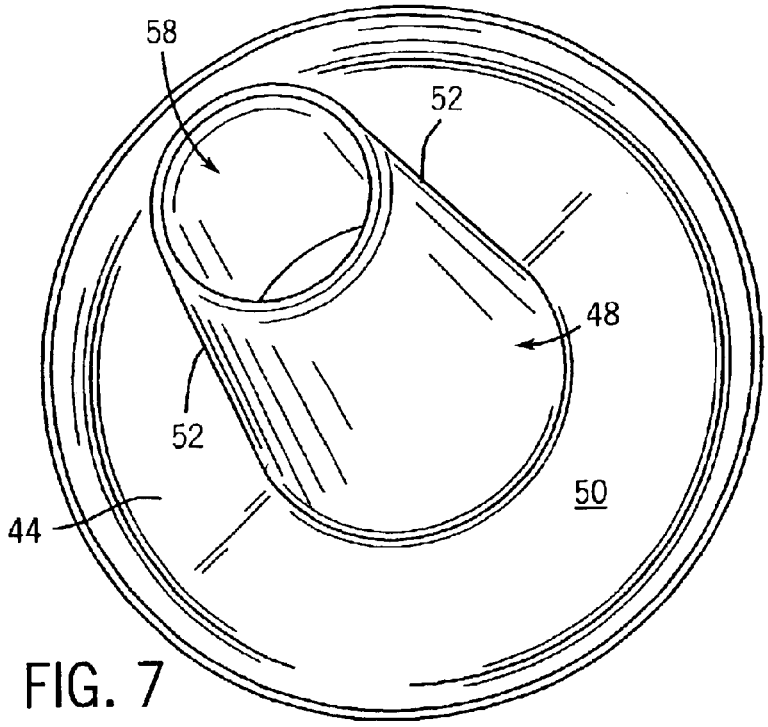
FIG. 7 illustrates a perspective view of a base, which includes a spool, of the container of FIG. 6 according to one aspect of the present invention.
Figure 8:
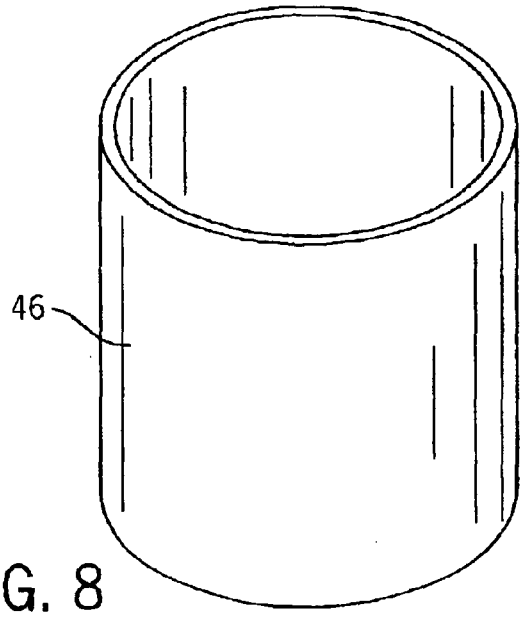
FIG. 8 illustrates a perspective view of a housing of the container of FIG. 6 according to one aspect of the present invention.

Referring to FIG. 6, container 42 for use with and for managing bulky chains (e.g., overhead track chains 20 as shown in FIGS. 4 and 5) is illustrated. When overhead track chains 20 are disposed within container 42, the container is capable of protecting these bulky chains from objects impacting the chains as well as from debris, moisture, and other contaminants. Such objects and contaminants can have adverse and/or deleterious effects upon overhead track chains 20. As shown in FIGS. 7 and 8, container 42 generally comprises base 44 and housing 46, respectively.

Referring to FIG. 7, base 44 includes spool 48 and defines top surface 50. Spool 48 is disposed upon, and extends diminishingly away from, top surface 50 of base 44. In other words, a periphery 52 (e.g., a circumference) of spool 48 gets smaller as the spool continues to extend and/or protrude farther away from top surface 50 of base 44. Therefore, in preferred embodiments, spool 48 is constructed to be frustoconical, conical, tapered, or the like (collectively "tapered"). The "tapered" and/or "diminishing" shape and/or configuration of spool 48 permits and/or encourages the overhead track chain 20 to be progressively guided and/or received around or proximate the spool in a winding fashion. The tapered nature of spool 48 essentially permits the spool to guide (e.g., direct, shepherd, etc.) overhead track chain 20 when the chain is wound about the spool. The tapered nature of spool 48 also encourages overhead track chain 20 to be wound such that the chain is centered and/or balanced within container 42.

As used herein, the phrases "progressively guided" and "progressively received generally signify that portions (e.g., segments) of overhead track chain 20 are deposited upon other previously-deposited portions of the chain as the chain is introduced into container 42. In other words, spool 48 guides overhead track chain 20 such that the chain is stacked, piled, and/or heaped upon itself. Also, since the chain is guided and received in a winding fashion, overhead track chain 20 essentially encircles and/or surrounds spool 48. In other words, as used herein, the phrase "winding fashion" generally means that overhead track chain 20 is more or less wrapped, either engagingly or proximately, around spool 48. In other words, spool 48 guides overhead track chain 20 such that the chain encircles, besieges, and/or surrounds the spool. Receipt of overhead track chain 20 can be performed, for example, by introducing the chain into container 42 in a clockwise or counter-clockwise manner.

Since spool 48 is tapered and acts as a guide for overhead track chain 20 when the chain is progressively received around the spool in a winding fashion, container 42 can accommodate the receipt of bulky, heavy chains that can swivel if not constrained. Container 42, and in particular spool 48, permits links 32, 34 in overhead track chain 42 to swivel just enough to permit the chain to be progressively guided and received in a winding fashion in container 42. At the same time, links 32, 34 inhibit and/or prevent overhead track chain 20 from pivoting, sagging, and otherwise becoming difficult to manage.

Figure 9:
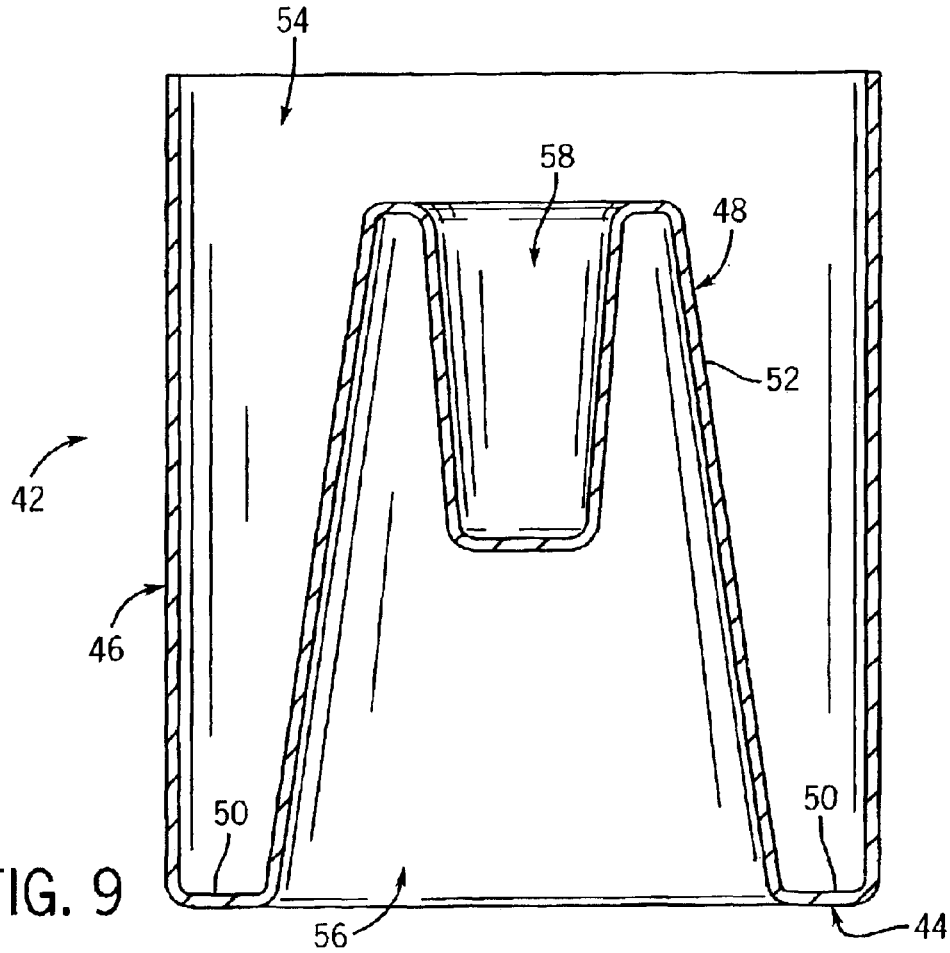
FIG. 9 illustrates a cross-sectional view, taken along line 9—9, of another embodiment of the container of FIG. 6 when the container has a unitary construction in accordance with another aspect of the present invention.

In one embodiment as shown in FIG. 8, housing 46 is cylindrical and is dimensioned to correspond to base 44 of FIG. 7. As such, housing 46 (FIG. 8) is securable to top surface 50 of base 44 (FIG. 7) by welding, a friction fit, rivets, nuts and bolts, and the like to produce container 42 as depicted in FIG. 6. In an alternative embodiment as shown in FIG. 9, container 42 can have a unitary construction. In other words, housing 46 and base 44 are simply "portions" of container 42 and the container is fashioned from a single piece of material. In other words, container 42 is essentially seamless.

Regardless of whether base 44 and housing 46 are secured together, or container 42 has a "one-piece" construction, housing 46 surrounds at least a portion of spool 48. Therefore, as illustrated in FIG. 9, housing 46, base 44, and spool 48 together form and define overhead track chain storage area 54. Overhead track chain storage area 54 capable of receiving overhead track chain 20. Overhead track chain storage area 54 is likewise capable of storing and/or holding overhead track chain 20 as well.

In a preferred embodiment as shown in FIG. 9, spool 48 includes an interior 56 that encompasses and contains accessory storage area 58. Accessory storage area 58 is capable of receiving one or more accessories (not shown) such as instructions for using overhead track chain 20, lubrication materials, nuts, bolts, links for the chain, and the like. In preferred embodiments, accessory storage area 58 is produced to be frustoconical, conical, tapered, concave, cylindrical, or the like. In those cases where accessory storage area 58 is frustoconical, conical, and tapered, the tapering and/or narrowing of accessory storage area 56 generally increases as the accessory storage area extends toward top surface 50.

Spool 48 is also preferably tapered about zero (0) to about fifteen (15) degrees and, therefore, an angle formed between periphery 52 of spool 48 and top surface 50 of base 44 is about ninety (90) to about one hundred five (105) degrees. In one exemplary embodiment, spool 48 is tapered about two (2) degrees when container 42 is dimensioned similarly to a three and a half (3½) gallon bucket as well known and conventionally used in the industry. Therefore, the angle that is formed between periphery 52 of spool 48 and top surface 50 of base 44 is about ninety-two (92) degrees. In another exemplary embodiment, spool 48 is tapered about four (4) degrees when container 42 is dimensioned similarly to a seven (7) gallon bucket as well known and conventionally used in the industry. Therefore, the angle that is formed between periphery 52 of spool 48 and top surface 50 of base 44 is about ninety-four (94) degrees.

Figure 10:
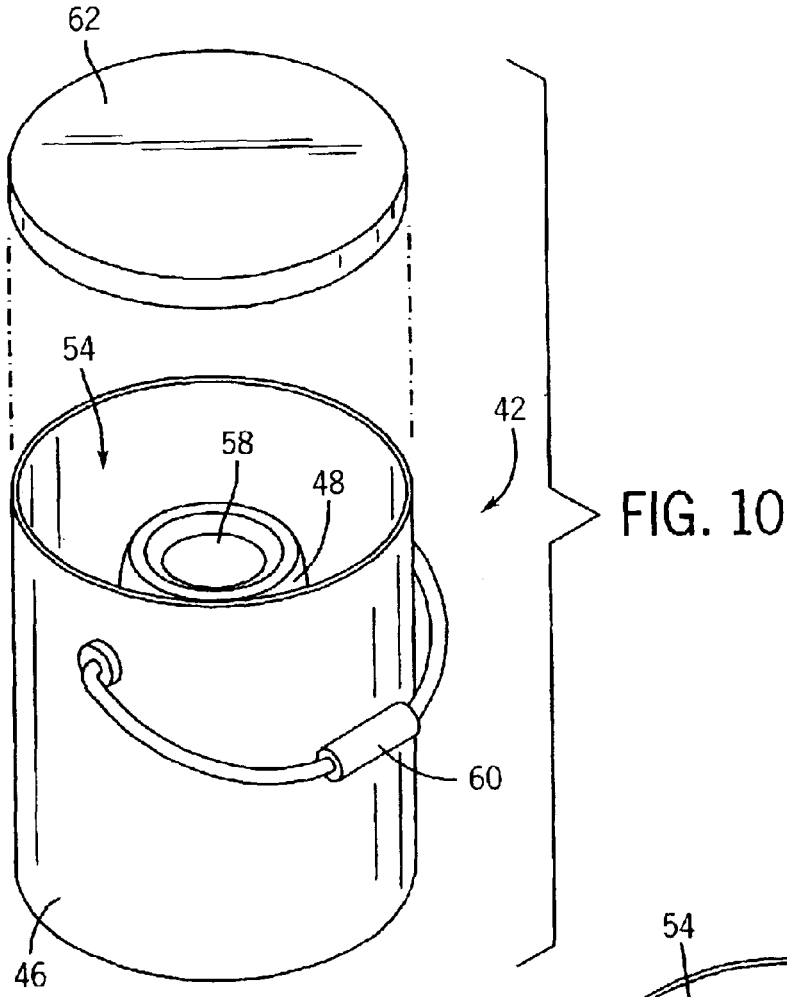
FIG. 10 illustrates the container of FIG. 6 including a lid and a handle according to one aspect of the present invention.

In a further preferred embodiment as shown in FIG. 10, container 42 includes handle 60 for carrying the container and/or a lid 62 for sealing the container. Handle 60 makes transportation of container 42 easier, more convenient, and the like. Lid 62, on the other hand, can afford increased protection (i.e., protection greater than that of container 42 acting alone) to overhead track chain 20 from objects that might strike and injure the chain as well as debris, moisture, and contaminants that might harm the chain.

Figure 11:
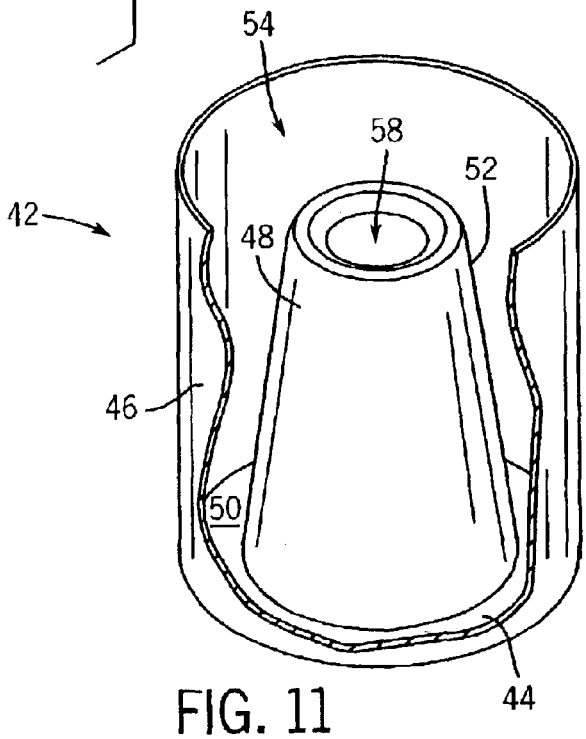
FIG. 11 illustrates the container of FIG. 6 having a partially cut-away housing highlighting the spool.

In FIG. 11, a portion of housing 46 has been cut-away or removed from container 42. Therefore, base 44, which operates either as a part or a portion of container 42, is more clearly illustrated. Also, FIG. 11 also provides a perspective view and otherwise displays accessory storage area 58 in container 42.

Figure 12:
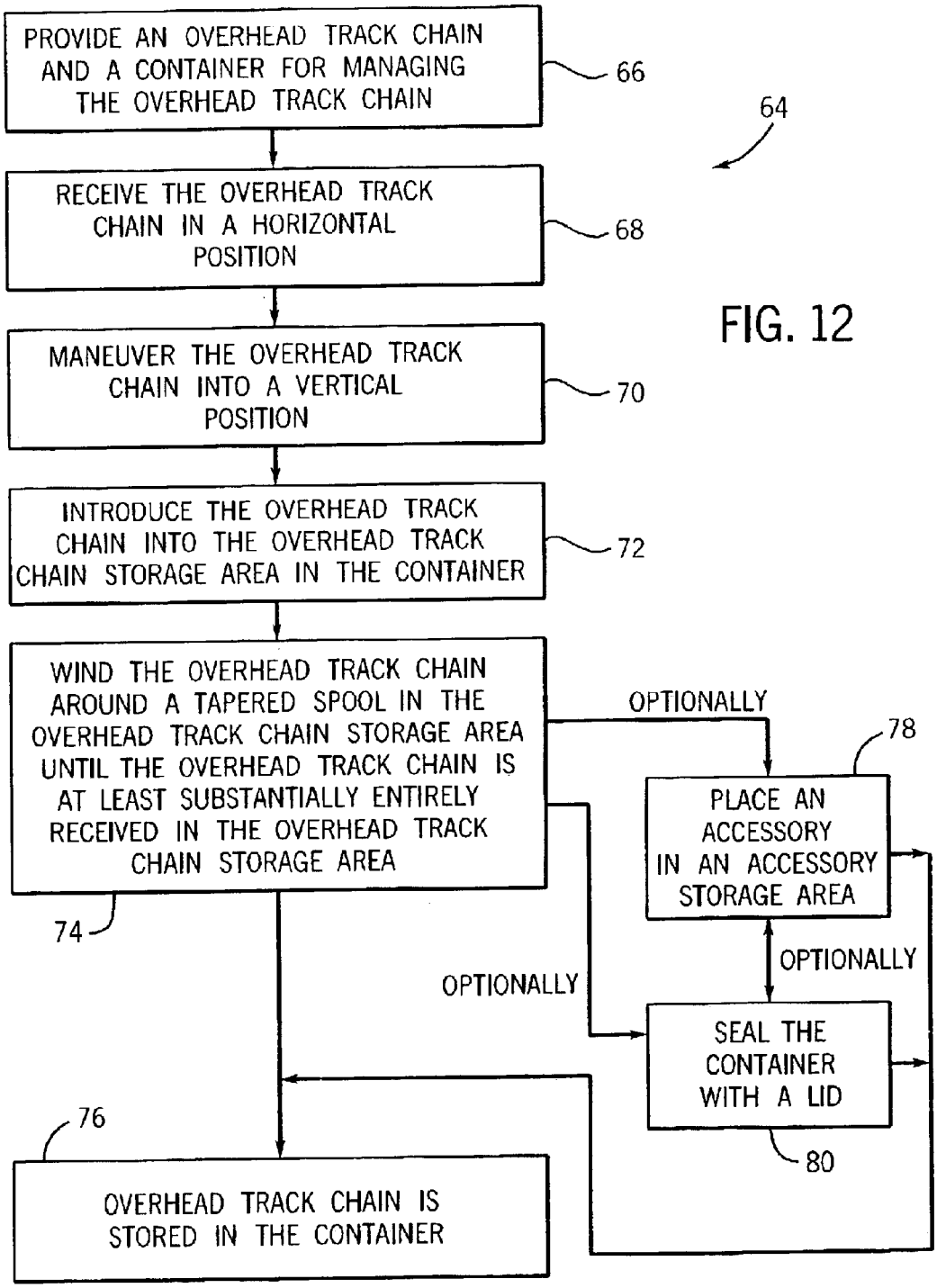
FIG. 12 illustrates a flow diagram that outlines a method for stowing the overhead track chain of FIG. 4 in the container of FIG. 6 according to one aspect of the present invention.

In the flow diagram of FIG. 12, a method or process 64 for stowing overhead track chain 20 in container 42 is illustrated. Process 64 begins by providing 66 overhead track chain 20 and container 20 for managing the chain. When overhead track chain 20 is provided, overhead track chain 20 is often (but not always) received 68 in a horizontal orientation as a result of having been operated in an track 14, having been recently assembled or constructed, and the like. Therefore, at least a portion of overhead track chain 20 is maneuvered 70 from the horizontal orientation into a vertical orientation.

Once at least a portion of the overhead track chain 20 is disposed in the vertically-oriented position, the chain is introduced 72 into overhead track chain storage area 62 in container 42. Introduction 72 of overhead track chain 20 can be performed by manually, semi-automatically, or automatically lowering vertically-oriented the overhead track chain into container 42. As used herein, manual insertion connotes insertion without the use or aid of automated, mechanical, and similar equipment. Semi-automatic and automatic would, therefore, require the use of machines, computers and networks, robotics, and the like.

Figure 13A:
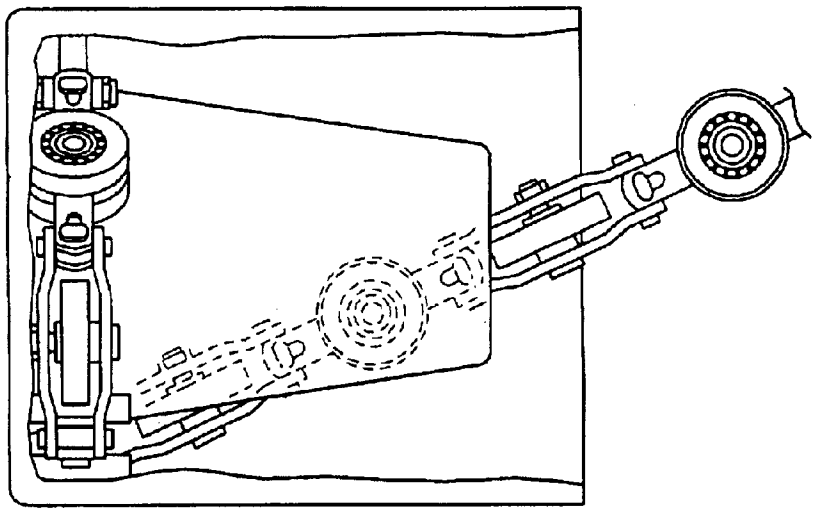
FIGS. 13A–B illustrate the container of FIG. 6 having a partially cut-away housing and receiving the overhead track chain of FIG. 4 in a winding fashion according to one aspect of the present invention.
Figure 13B:
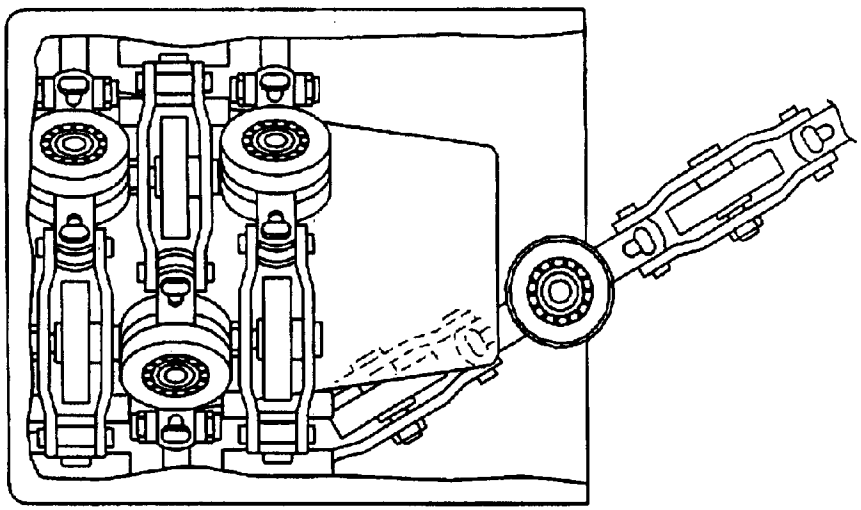

After entering overhead track chain storage area 62, the now vertically-oriented overhead track chain 20 (or portion thereof) is wound 74 (i.e., coiled, spiraled, etc.) around tapered spool 48 in overhead track chain storage area 62 of container 42 as progressively shown in FIGS. 13A–B. Overhead track chain 20 preferably winds such that the chain is centered and/or balanced in overhead track chain storage area 54 in container 42.

Winding 74 of overhead track chain 20 can be performed by permitting container 42 to rotate or by rotating the container. For example, container 42 can rotate as a result of interaction between overhead track chain 20 and tapered spool 48. Since overhead track chain 20 is heavy, and spool 48 is tapered, the chain naturally "winds" when lowered into container 42. Alternatively or additionally, a mechanical device (not shown) can rotate container 42 to assist or entirely perform winding 74. Mechanical devices capable of providing rotation or a rotating force, as well as their manner of use, are well known in the art.

Figure 14:
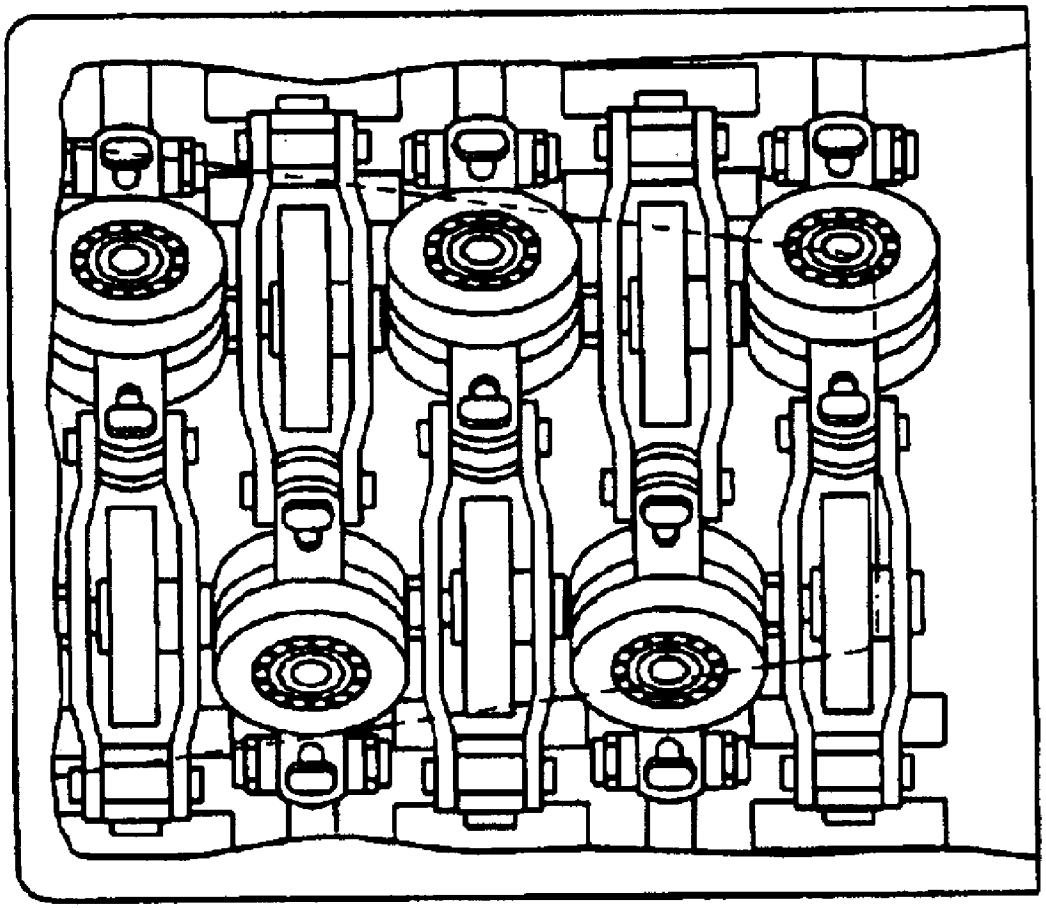
FIG. 14 illustrates the container of FIG. 6 having a partially cut-away housing when the overhead track chain of FIG. 4 is stowed in the container according to one aspect of the present invention.

Winding 74 of overhead track chain 20 around tapered spool 48 continues until the chain is at least substantially entirely received within overhead track chain storage area 54 as shown in FIG. 14. Therefore, as depicted in FIG. 14, overhead track chain 20 has been received in a winding fashion around spool 48 and within overhead track chain storage area 54. Thus, overhead track chain 20 is stowed 76 (i.e., stored, packaged, etc.) in container 42.

When overhead track chain 20 is stored in container 42, the container can protect the overhead track chain from objects striking the chain, contaminants harming the chain, and the like. In a similar fashion, container 42 can also protect one or more accessories (not shown) when the accessories are optionally placed 78 (FIG. 12) and/or stored in accessory storage area 58. Contents (e.g., overhead track chain, accessories, etc.) of container 42 can be additionally protected if the container is optionally sealed 80 with lid 60 (FIG. 12).

To remove overhead track chain 20 from container 42, the chain is grasped (preferably by a link 32, 34 having a universal pin 40 that is not attached to another link) and pulled upwardly and/or away from the container. When this occurs, overhead track chain 20 unwinds and is allowed to discharge and/or be expelled from container 42. Therefore, container 42 permits and is structured for removal of overhead track chain 20 as well as managing the chain.

In addition to compatibility with overhead track chains 20, container 42 can be suitably employed to accommodate and receive equivalent heavy, bulky chains such as those used in power and free conveyors, continuous flow conveyors, hand-pushed conveyors, over-and-under conveyors, wide-track conveyors, enclosed track conveyors, caterpillar drive conveyors, I-beam conveyors, floor chain conveyors, chain on edge conveyors, and the like.

In preferred embodiments, base 44, spool 48, and housing 46 can be constructed of plastic, polypropylene, polyethylene, nylon, steel, wood, cardboard, and like materials. Therefore, container 42 can be made using an injection molding process or other molding processes as well known in the art.

Despite any methods being outlined in a step-by-step sequence, the completion of acts or steps in a particular chronological order is not mandatory. Further, elimination, modification, rearrangement, combination, reordering, or the like, of acts or steps is contemplated and considered within the scope of the description and appended claims.

Also, while the present invention has been described in terms of the preferred embodiment, it is recognized that equivalents, alternatives, and modifications, aside from those expressly stated, are possible and within the scope of the description and appended claims.

What is claimed is:

1. A container for use with an overhead track chain, the container comprising:

a base having a spool, the spool extending from the base and structured to progressively guide the overhead track chain around the spool in a winding fashion; and a housing securable to the base and surrounding at least a portion of the spool to form an overhead track chain storage area;

wherein the overhead track chain is guided around the spool in the winding fashion and received within the overhead track chain storage area.

2. The container of claim 1, wherein the spool has a shape selected from the group consisting of frustoconical, conical, or tapered.

3. The container of claim 1, wherein the spool includes an accessory storage area within the spool.

4. The container of claim 3, wherein the accessory storage area has a shape selected from the group consisting of frustoconical, conical, tapered, concave, or cylindrical.

5. The container of claim 1, wherein the container includes at least one of a handle for transporting the container and a lid for sealing the container.

6. The container of claim 1, wherein at least one of the base and the housing are constructed of a material selected from the group consisting of plastic, polypropylene, polyethylene, nylon, steel, wood, and cardboard.

7. The container of claim 1, wherein the overhead track chain is structured for use with a conveyor selected from the group consisting of a power and free conveyor, a continuous flow conveyor, a hand-pushed conveyor, an over-and-under conveyor, a wide-track conveyor, an enclosed track conveyor, a caterpillar drive conveyor, an I-beam conveyor, a floor chain conveyor, and a chain on edge conveyor.

8. A container for managing an overhead track chain, the container comprising:

a base defining a top surface;

a tapered spool defining an interior, the tapered spool:

disposed upon and extending diminishingly away from the top surface of the base;

having an accessory storage area disposed within the interior of the tapered spool; and structured to progressively guide the overhead track chain around the tapered spool in a winding fashion; and a cylindrical housing securable to the top surface of the base and surrounding at least a portion of the tapered spool to form an overhead track chain storage area;

wherein the overhead track chain is guided around the tapered spool in a winding fashion and received within the overhead track chain storage area.

9. The container of claim 8, wherein an angle formed between a periphery of the tapered spool and the top surface of the base is about ninety to about one hundred five degrees.

10. The container of claim 8, wherein an angle formed between a periphery of the tapered spool and the top surface of the base is about ninety-two degrees.

11. The container of claim 8, wherein an angle formed between a periphery of the tapered spool and the top surface of the base is about ninety-four degrees.

12. The container of claim 8, wherein the accessory storage area has a shape selected from the group consisting of frustoconical, conical, tapered, concave, or cylindrical.

13. The container of claim 8, wherein the base, the tapered spool, and the cylindrical housing are of unitary construction.

14. The container of claim 8, wherein the container includes at least one of a handle for transporting the container and a lid for sealing the container.

15. The container of claim 8, wherein at least one of the base, the tapered spool, and the cylindrical housing are constructed of a material selected from the group consisting of plastic, polypropylene, polyethylene, nylon, steel, wood, and cardboard.

16. The container of claim 8, wherein managing includes at least one of packaging, transporting, storing, handling, or maneuvering the overhead track chain.

17. A method of stowing an overhead track chain, the method comprising:

providing the overhead track chain;

providing a container for managing the overhead track chain, the container including a base having a tapered spool, the tapered spool extending from the base and structured to progressively guide the overhead track chain/around the tapered spool in a winding fashion, and a housing securable to the base and surrounding at least a portion of the tapered spool to form an overhead track chain storage area;

introducing a vertically-oriented overhead track chain into the overhead track chain storage area within the container; and winding the vertically-oriented overhead track chain around the tapered spool in the overhead track chain storage area of the container until the overhead track chain is at least substantially entirely received within the overhead track chain storage area such that the overhead track chain is stowed.

18. The method of claim 17, wherein, prior to the introducing step, the method further comprises maneuvering at least a portion of the overhead track chain into a vertical orientation.

19. The method of claim 17, wherein, prior to the maneuvering step, the method further comprises receiving the overhead track chain in a horizontal orientation.

20. The method of claim 17, wherein the introducing step is performed by lowering the vertically-oriented overhead track chain into the container using one of the techniques selected from the group consisting of manually, semi-automatically, and automatically.

21. The method of claim 17, wherein the winding step is performed by rotation of the container that is the result of interaction between the overhead track chain and the tapered spool.

22. The method of claim 17, wherein the method includes rotating the container by using a mechanical device.

23. The method of claim 17, wherein the method further comprises guiding the overhead track chain into the overhead track chain storage area in the container during the introducing step using the tapered spool.

24. The method of claim 17, wherein the method further comprises using the tapered spool to guide the overhead track chain into the overhead track chain storage area of the container.

25. The method of claim 17, wherein the method further comprises placing an accessory into an accessory storage area disposed within the tapered spool.

26. The method of claim 17, wherein the method further comprises sealing the container with a lid.

27. The method of claim 17, wherein the overhead track chain comprises a series of alternating, pivotable load-carrying and lateral support links.

28. A container in combination with an overhead track chain, the container comprising a base having a tapered spool, the tapered spool extending from the base and structured to progressively guide the overhead track chain around the tapered spool in a winding fashion, and a housing securable to the base and surrounding at least a portion of the tapered spool to form an overhead track chain storage area, and the overhead track chain at least substantially entirely disposed within the container, the overhead track chain comprising a load-carrying link and a lateral guide link, each of the load-carrying link and the lateral guide link having a universal pin and a universal pin aperture such that the load-carrying link and the lateral guide link are pivotable with respect to each other, the pivotable load-carrying link and the lateral guide link permitting the overhead track chain to be guided around the tapered spool in the winding fashion and received within the overhead track chain storage area.

* * * * *